US010916256B2

(12) United States Patent
Żernicki et al.

(10) Patent No.: US 10,916,256 B2
(45) **Date of Patent: *Feb. 9, 2021**

(54) METHOD AND APPARATUS FOR SINUSOIDAL ENCODING AND DECODING

(71) Applicants: Huawei Technologies Co., Ltd., Shenzhen (CN); ZYLIA SP. Z O.O., Poznan (PL)

(72) Inventors: Tomasz Żernicki, Poznan (PL); Łukasz Januszkiewicz, Poznan (PL); Panji Setiawan, Munich (DE)

(73) Assignees: Huawei Technologies Co., Ltd., Shenzhen (CN); ZYLIA SP. Z O.O., Poznan (PL)

( * ) Notice: Subject to any disclaimer, the term of this patent is extended or adjusted under 35 U.S.C. 154(b) by 0 days.

This patent is subject to a terminal disclaimer.

(21) Appl. No.: 16/702,234

(22) Filed: Dec. 3, 2019

(65) Prior Publication Data

US 2020/0105284 A1 Apr. 2, 2020

Related U.S. Application Data

(63) Continuation of application No. 15/928,930, filed on Mar. 22, 2018, which is a continuation of application No. PCT/EP2016/074742, filed on Oct. 14, 2016.

(30) Foreign Application Priority Data

Oct. 15, 2015 (EP) ..... 15189865

(51) Int. Cl.
*G10L 19/00* (2013.01)
*G10L 19/02* (2013.01)
(Continued)

(52) U.S. Cl.
CPC ..... *G10L 19/0212* (2013.01); *G10L 19/008* (2013.01); *G10L 19/02* (2013.01); *G10L 19/032* (2013.01)

(58) Field of Classification Search
CPC ..... G10L 19/00
(Continued)

(56) References Cited

U.S. PATENT DOCUMENTS 5,536,902 A * 7/1996 Serra ..... G10H 3/125 84/623
6,182,042 B1 1/2001 Peevers
(Continued)

FOREIGN PATENT DOCUMENTS

AU 2006332046 B2 8/2011
AU 2011205144 A1 8/2011
(Continued)

OTHER PUBLICATIONS

Levine et al., "A switched parametric and transform audio coder," 1999 IEEE International Conference on Acoustics, Speech, and Signal Processing, ICASSP '99, Phoenix, Arizona, USA, pp. 985-988, Institute of Electrical and Electronics Engineers, New York, New York (Mar. 15-19, 1999).
(Continued)

*Primary Examiner* — Michael Colucci
(74) *Attorney, Agent, or Firm* — Leydig, Voit & Mayer, Ltd.

(57) ABSTRACT

An audio signal encoding method is provided that comprises collecting audio signal samples, determining sinusoidal components in subsequent frames, estimating amplitudes and frequencies of the components for each frame, merging the obtained pairs into sinusoidal trajectories, splitting particular trajectories into segments, transforming particular trajectories to the frequency domain by way of a digital
(Continued)

transform performed on segments longer than the frame duration, quantization and selection of transform coefficients in the segments, entropy encoding, outputting the quantized coefficients as output data, wherein segments of different trajectories starting within a particular time are grouped into Groups of Segments, and the partitioning of trajectories into segments is synchronized with the endpoints of a Group of Segments.

20 Claims, 15 Drawing Sheets

(51) Int. Cl.
*G10L 19/008* (2013.01)
*G10L 19/032* (2013.01)

(58) Field of Classification Search
USPC ..... 84/623, 616, 611; 704/500, 201, 267, 704/223, 219, 207, 205; 455/66.1; 381/17
See application file for complete search history.

(56) References Cited

U.S. PATENT DOCUMENTS 6,564,176 B2 * 5/2003 Kadtke ..... G06K 9/6217 702/189
6,573,890 B1 * 6/2003 Lengyel ..... G06T 9/001 345/418
7,433,743 B2 * 10/2008 Pistikopoulos ..... G05B 13/048 700/29
7,589,931 B2 * 9/2009 Baek ..... G11B 5/5547 318/560
7,596,494 B2 9/2009 Kristjansson et al.
7,640,156 B2 12/2009 Gerrits et al.
8,135,047 B2 3/2012 Rajendran et al.
8,417,751 B1 * 4/2013 Yagnik ..... G06F 17/15 382/279
9,111,525 B1 8/2015 Mouchtaris et al.
2002/0198697 A1 * 12/2002 Datig ..... G06N 3/004 704/1
2004/0162721 A1 * 8/2004 Oomen ..... G10L 19/0212 704/203
2005/0075869 A1 * 4/2005 Gersho ..... G10L 19/173 704/223
2005/0078832 A1 * 4/2005 Van De Par ..... G10L 19/08 381/17
2005/0149321 A1 * 7/2005 Kabi ..... G10L 25/90 704/207
2005/0174269 A1 8/2005 Sherigar et al.
2006/0009967 A1 1/2006 Gerrits et al.
2006/0082922 A1 * 4/2006 Shih ..... G11B 5/5547 360/78.06
2006/0112811 A1 * 6/2006 Padhi ..... G10H 7/08 84/616
2006/0226357 A1 * 10/2006 Franzen ..... H01J 49/38 250/307
2006/0277038 A1 * 12/2006 Vos ..... G10L 19/0208 704/219
2007/0238415 A1 * 10/2007 Sinha ..... G10L 19/0208 455/66.1
2008/0027711 A1 * 1/2008 Rajendran ..... G10L 19/167 704/201
2009/0055197 A1 * 2/2009 Lee ..... G10L 19/093 704/500
2009/0063162 A1 3/2009 Lee et al.
2009/0119097 A1 * 5/2009 Master ..... G10H 1/0008 704/207
2011/0106529 A1 * 5/2011 Disch ..... G10L 19/0204 704/205
2012/0067196 A1 * 3/2012 Rao ..... G10H 1/363 84/611
2013/0038486 A1 * 2/2013 Lee ..... G01S 7/412 342/192
2015/0302845 A1 * 10/2015 Nakano ..... G10L 13/02 704/267
2015/0332676 A1 * 11/2015 Disch ..... G10L 21/038 704/500
2017/0143272 A1 * 5/2017 Brouse ..... A61B 5/7203
2018/0018978 A1 1/2018 Bartkowiak et al.

FOREIGN PATENT DOCUMENTS

CN 101290774 A 10/2008
CN 103493130 A 1/2014
CN 103946918 A 7/2014
EP 1662479 A1 5/2006
PL 410945 A1 8/2016
WO 0122403 A1 3/2001

OTHER PUBLICATIONS

Zheng et al., "Superwideband Variable Bit-Rate Speech and Audio Codec: ITU-T G.729.1 Annex E," Journal of Military Communications Technology, vol. 32, No. 4, pp. 95-99, with English Abstract, China Academic Journal Electronic Publishing, Tsinghua University, Tsinghua, China (Dec. 2011).
U.S. Appl. No. 15/928,930, filed Mar. 22, 2018.
Zernicki et al.,"MPEG-H 3D Audio Phase 2 Core Experiment Proposal on tonal component coding", ISO/IEC JTC1/SC29/WG11 MPEG2015/M35934, Geneva, Switzerland, (Feb. 2015).
Zernicki et al., "Updated MPEG-H 3D Audio Phase 2 Core Experiment Proposal on tonal component coding", ISO/IEC JTC1/SC29/WG11 MPEG2015/M36538, Warsaw, Poland (Jun. 2015).
"Zylia Listening Test Report on High Frequency Tonal Component Coding CE," ISO/IEC JTC1/SC29/WG11 MPEG2015/M37215, Geneva, Switzerland, (Oct. 2015).
"Workplan for MPEG-H 3D Audio," ISO/IEC JTC1/SC29/WG11 MPEG2015/N15582, Warsaw, Poland (Jun. 2015).
Zernicki et al., "Enhanced Coding of High-Frequency Tonal Components in MPEG-D USAC Through Joint Application of ESBR and Sinusoidal Modeling," ICASSP 2011, Institute of Electrical and Electronics Engineers, New York, New York (2011).
Zernicki et al.,"Application of sinusoidal coding for enhanced bandwidth extension in MPEG-D USAC," in Audio Engineering Society 138th Convention, Warsaw, Poland, May 2015, 10 pages.
Disch et al.,"Cheap Beeps—Efficient Synthesis of Sinusoids and Sweeps in the MDCT Domain," Proceedings of ICASSP 2013, XP055091657, Institute of Electrical and Electronics Engineers, New York, New York (May 2013).
Purnhagen, "Advances in parametric audio coding," 1999 IEEE Workshop on New Paltz Applications of Signal Processing to Audio and Acoustics, XP010365061, Institute of Electrical and Electronics Engineers, New York, New York (Oct. 1999).

* cited by examiner

METHOD AND APPARATUS FOR SINUSOIDAL ENCODING AND DECODING

CROSS-REFERENCE TO RELATED APPLICATIONS

This application is a continuation of U.S. application Ser. No. 15/928,930, filed on Mar. 22, 2018, which is a continuation of International Application No. PCT/EP2016/074742, filed on Oct. 14, 2016, which claims priority to European Patent Application No. 15189865.7, filed on Oct. 15, 2015. All of the afore-mentioned patent applications are hereby incorporated by reference in their entireties.

TECHNICAL FIELD

This application relates to the field of audio coding, and in particular to the field of sinusoidal coding of audio signals.

BACKGROUND

For the MPEG-H 3D Audio Core Coder a High Frequency Sinusoidal Coding (HFSC) enhancement has been proposed. The respective HFSC tool was already presented in 111th MPEG meeting in Geneva [1] and in 112th meeting in Warsaw [2].

SUMMARY

It is an object of the present invention to provide improvements, for example, the MPEG-H 3D Audio Codec, and in particular for the respective HFSC tool. However, embodiments of the present invention may also be used in and for other audio codecs using sinusoidal coding. The term "codec" refers to or defines the functionalities of the audio encoder/encoding and audio decoder/decoding to implement the respective audio codec.

Embodiments of the invention can be implemented in hardware or in software or in any combination thereof.

SHORT DESCRIPTION OF THE FIGURES

Figure 4A:
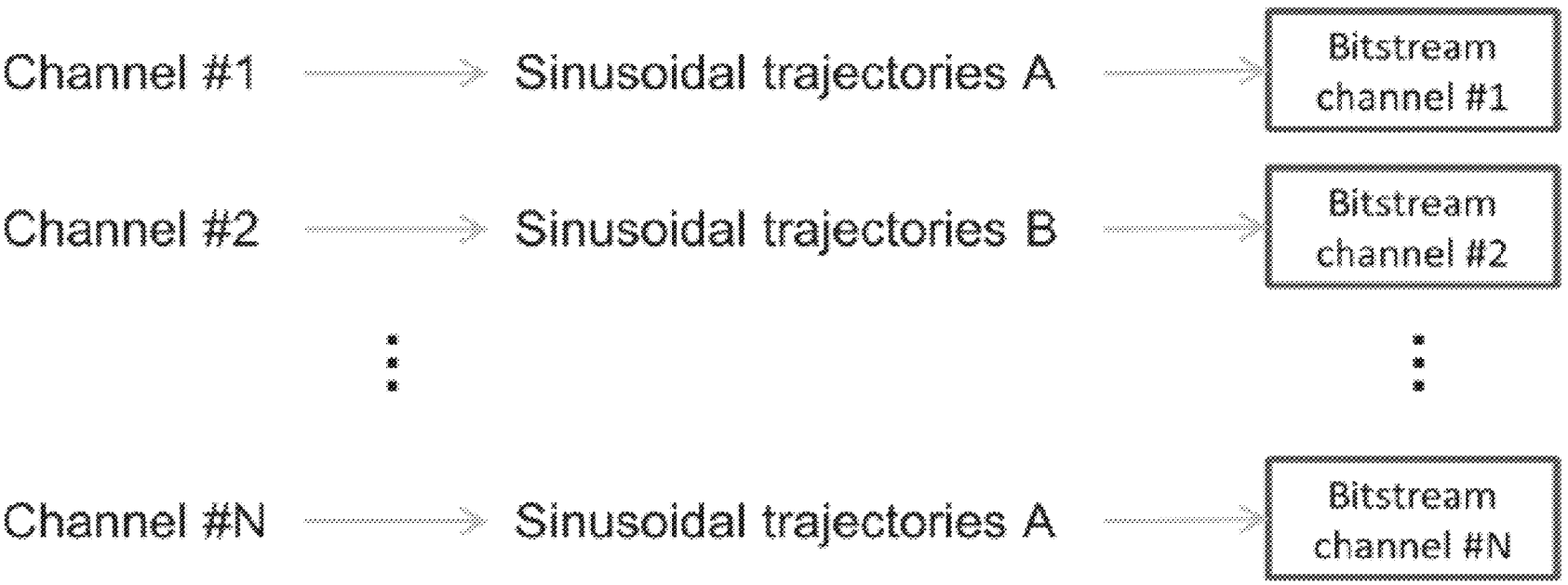

FIG. 4*a* shows an illustration of independent encoding for each channel according to an embodiment of the invention.

Figure 4B:
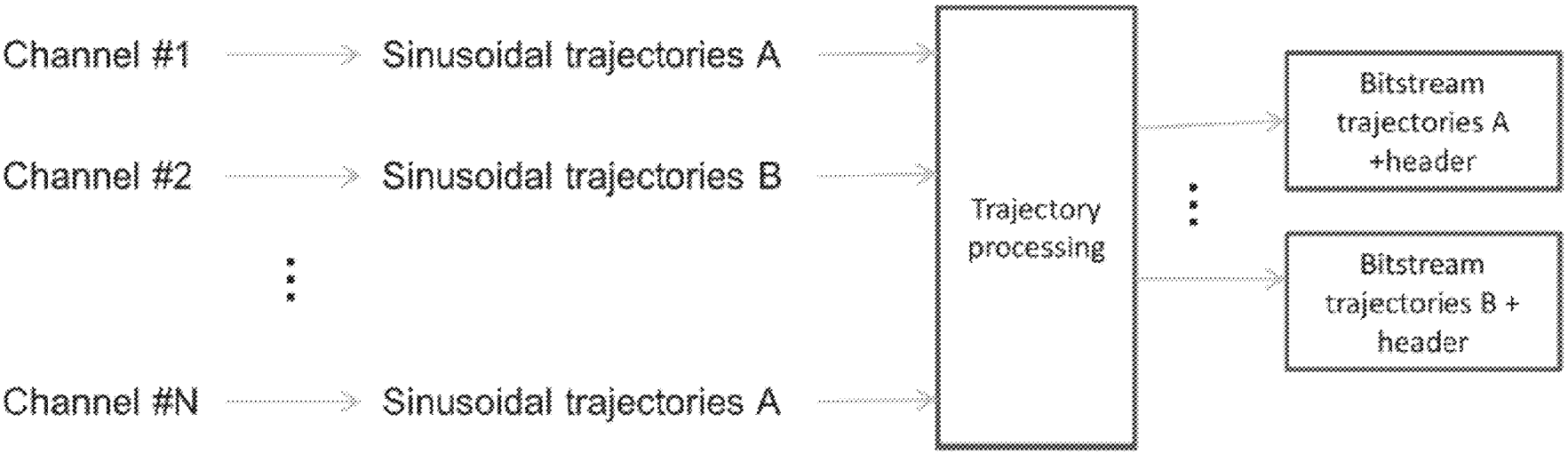

FIG. 4*b* shows illustration of sending additional information related to trajectory panning according to an embodiment of the invention.

Figure 5:
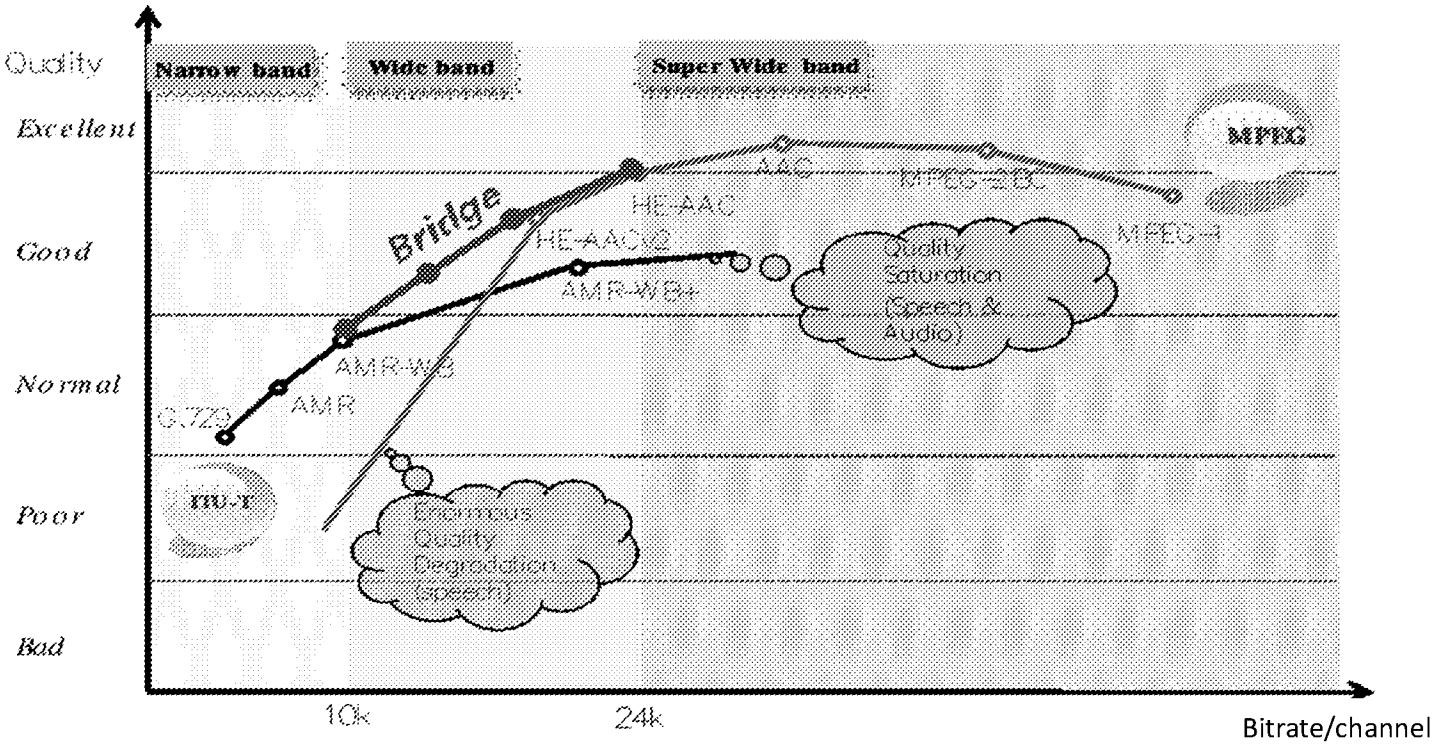

FIG. 5 shows the motivation for embodiments of the present invention.

Figure 6:
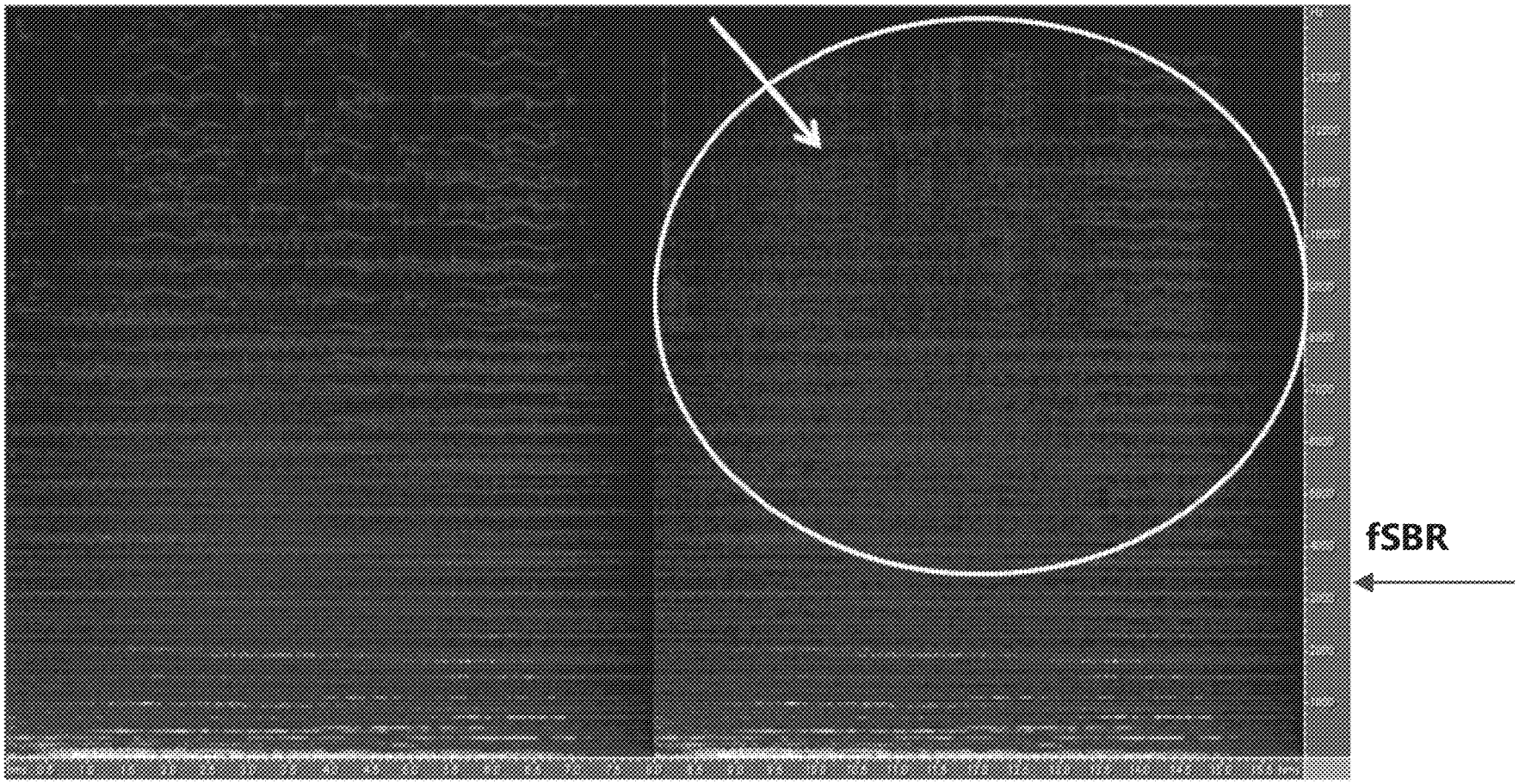

FIG. 6 shows exemplary MPEG-H 3D Audio artifacts above fSBR.

Figure 7:
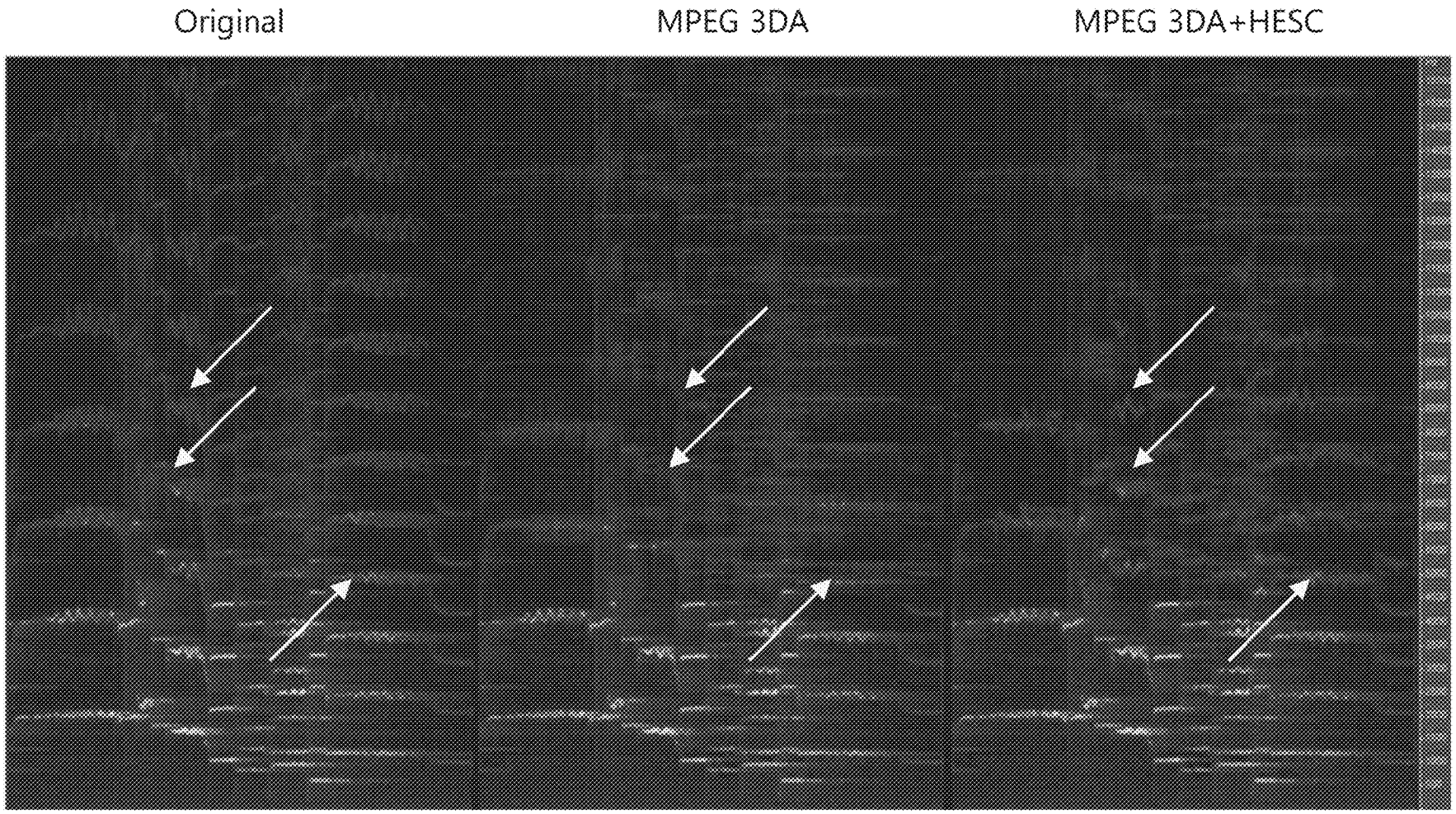

FIG. 7 shows a comparison for 20 kbps (~2 kbps of HESC), fSBR=4 kHz, between "Original", "MPEG 3DA" and "MPEG 3DA+HESC".

Figure 8:
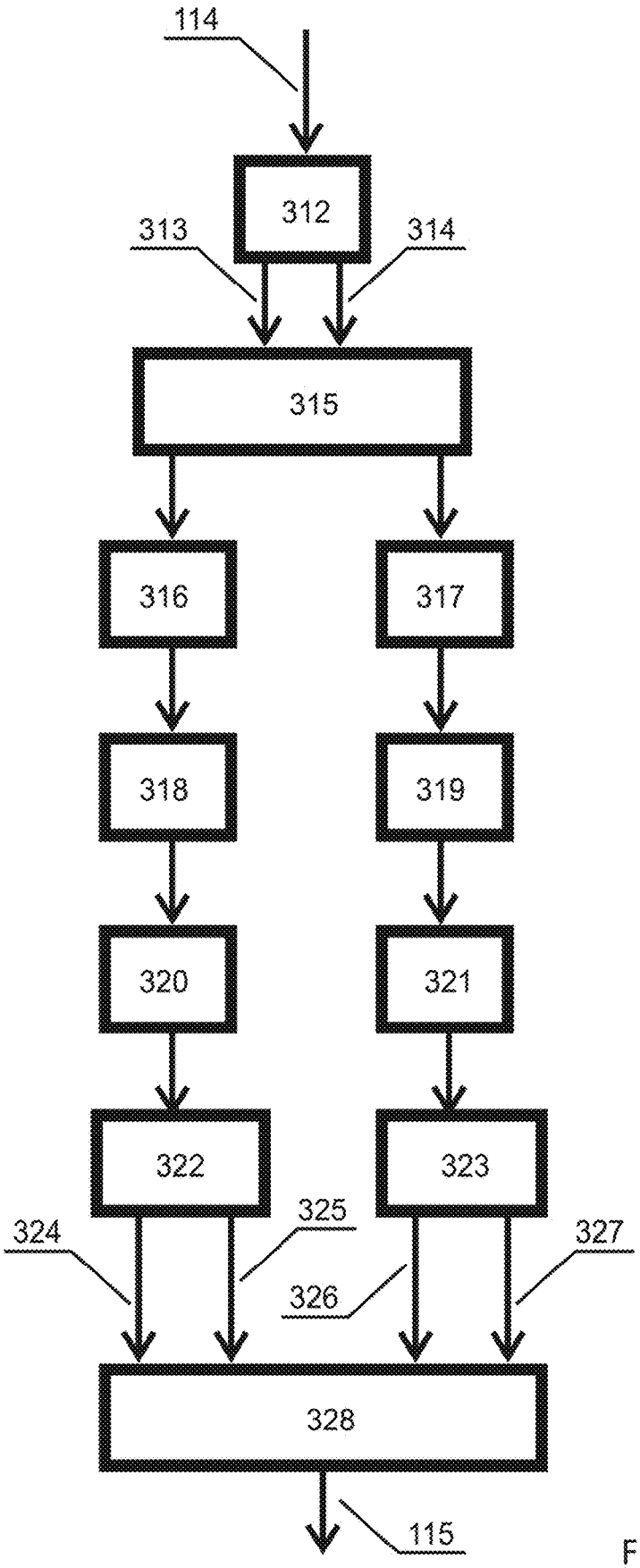

FIG. 8 shows a flow-chart of an exemplary decoding method.

Figure 9:
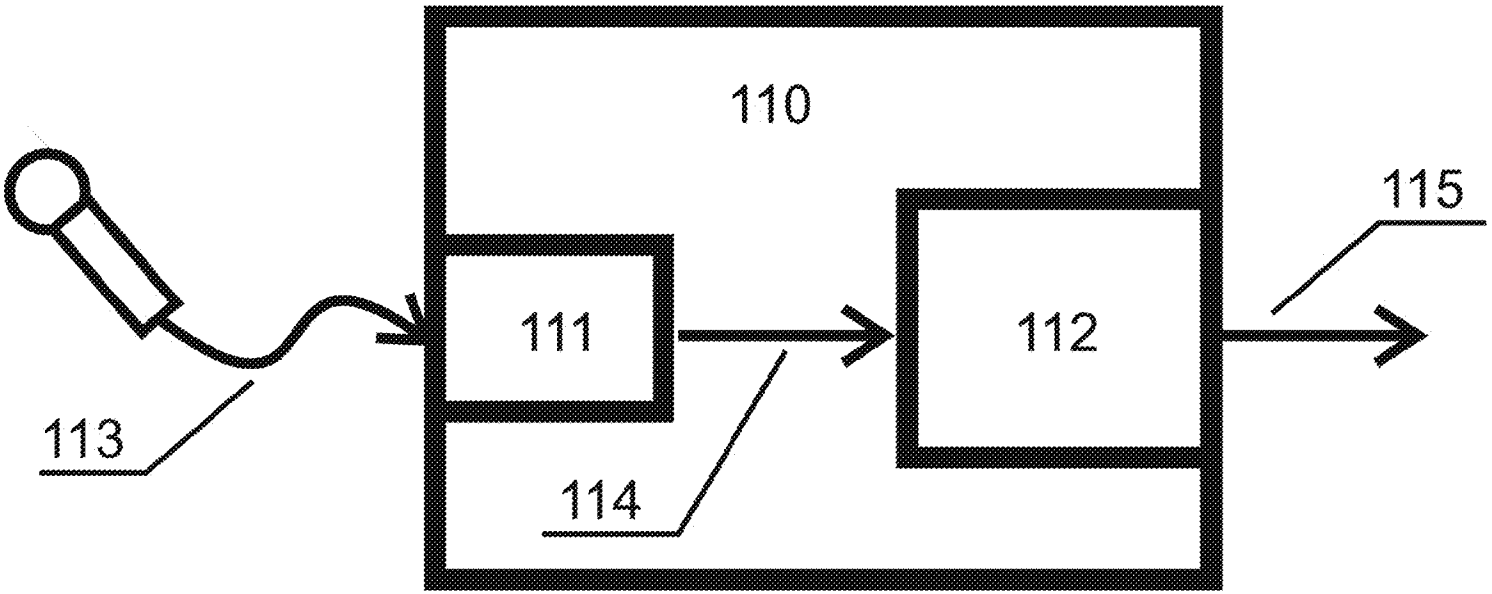

FIG. 9 shows a block-diagram of an exemplary decoder.

Figure 10:
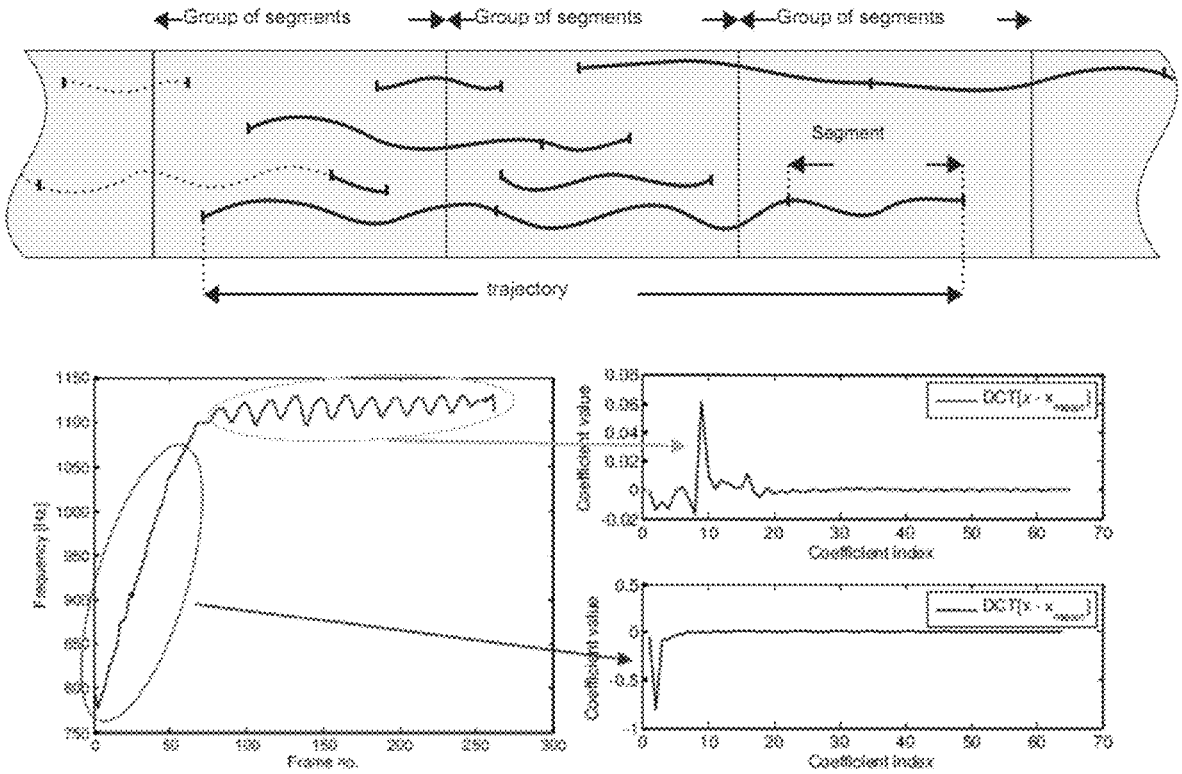

FIG. 10 shows an example analysis of sinusoidal trajectories showing sparse DCT spectra according to prior art.

Figure 11:
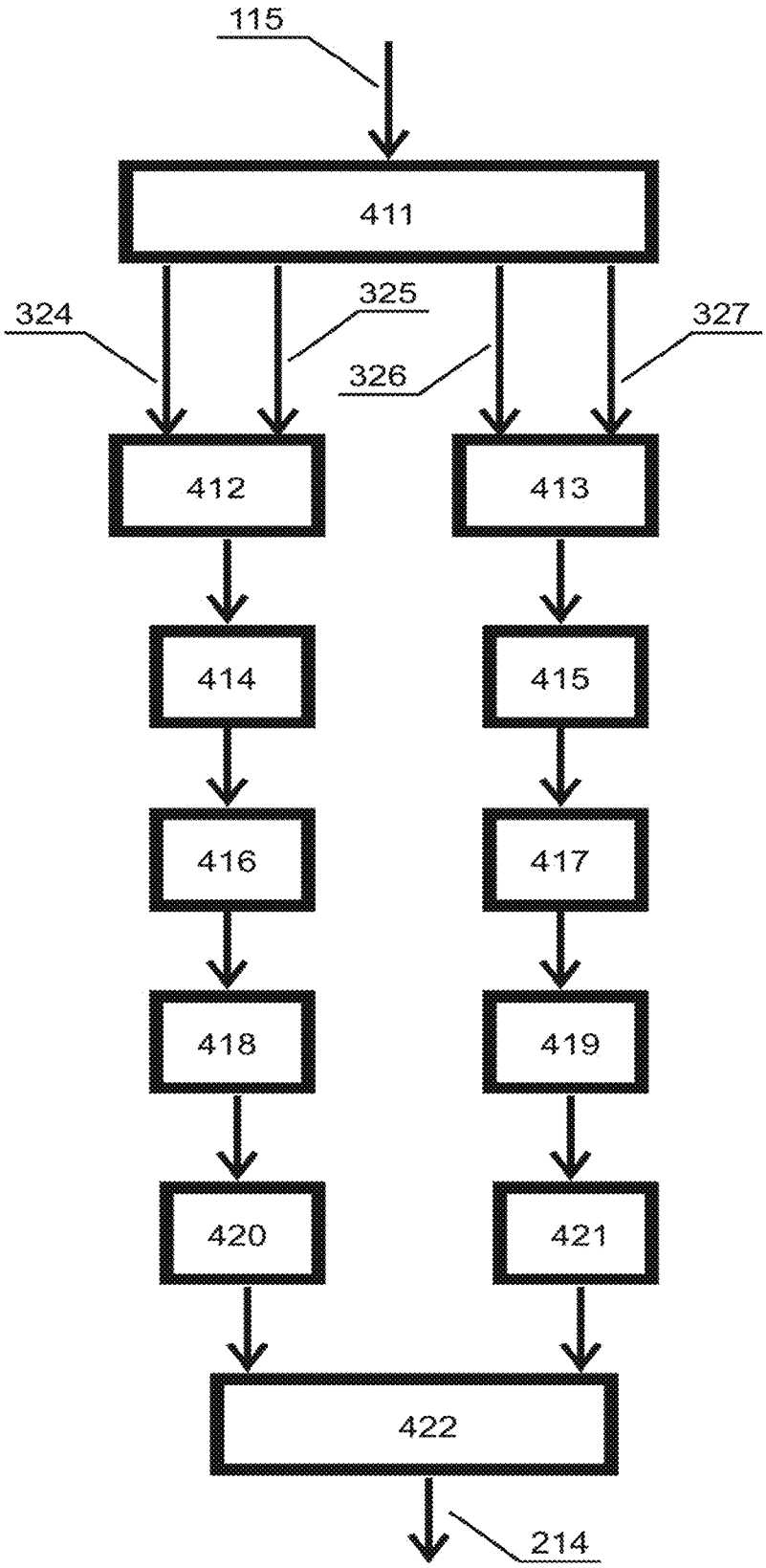

FIG. 11 shows a flow-chart of an exemplary decoding method.

Figure 12:
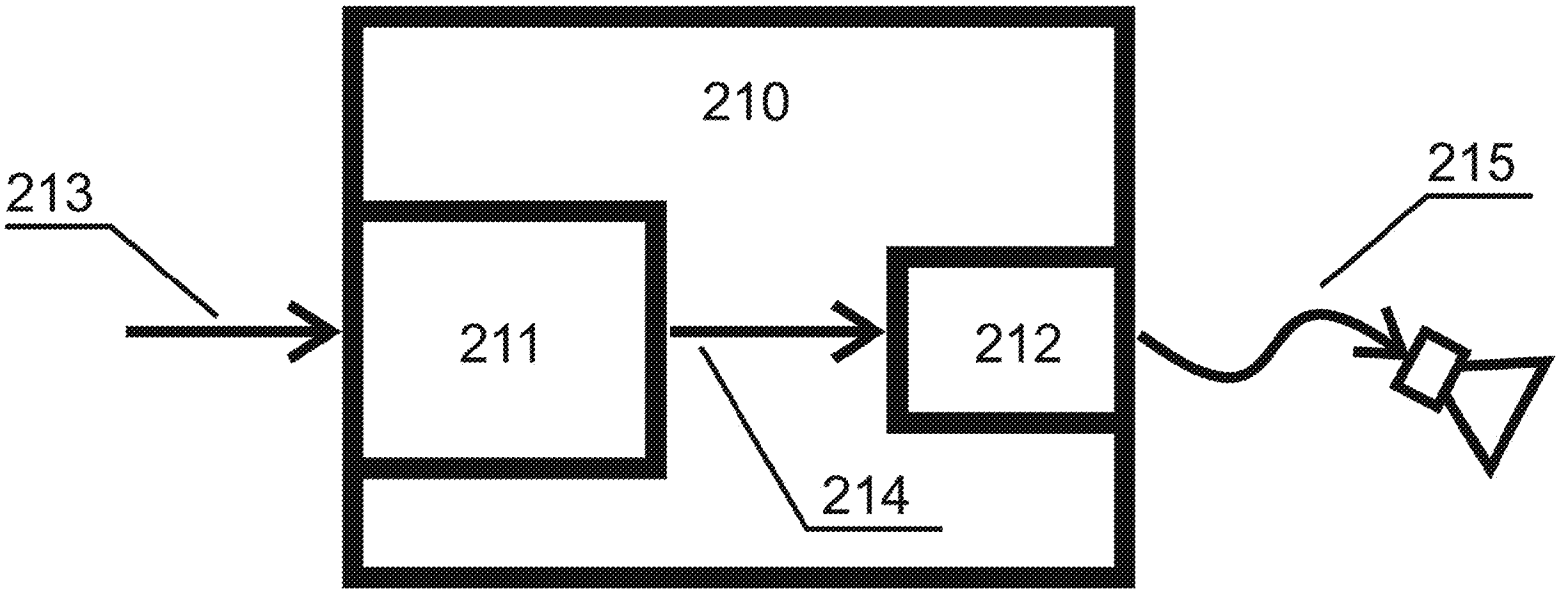

FIG. 12 shows a block diagram of a corresponding exemplary decoder.

Figure 13:
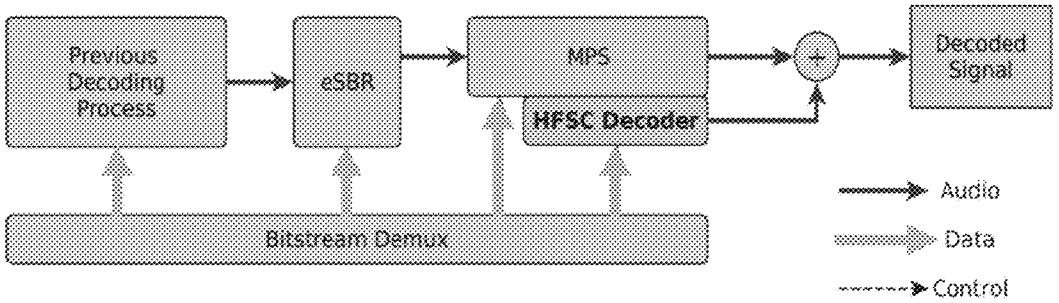
Figure 13:
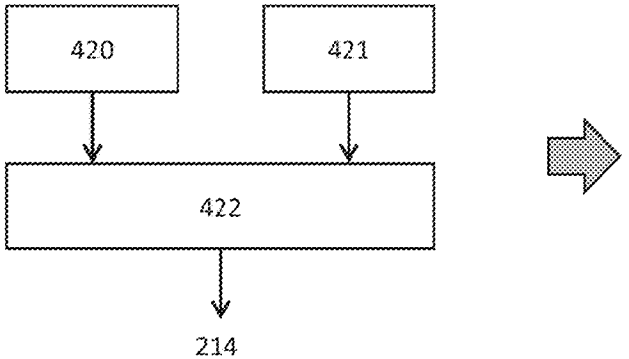
Figure 13:
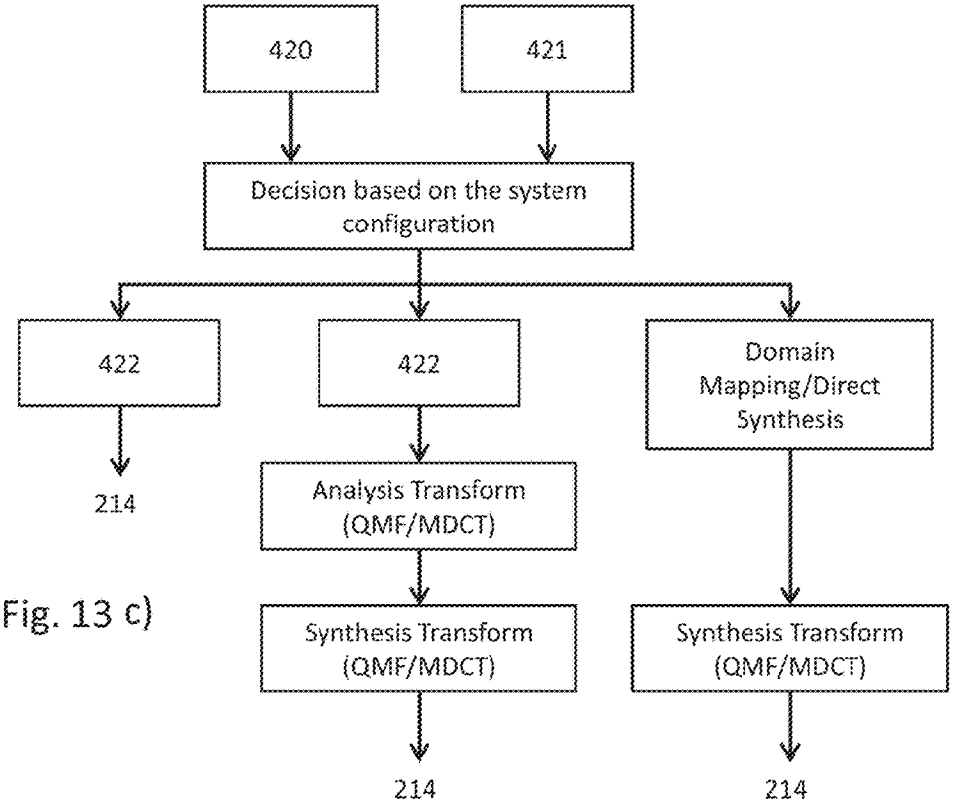

FIG. 13*a* shows another embodiment of the invention, in particular the general location of the proposed tool within the MPEG-H 3D Audio Core Encoder.

FIG. 13*b* shows a part of FIG. 11.

FIG. 13*c* shows an embodiment of the present invention, wherein the steps depicted therein replace the respective steps in FIG. 13*b*).

Figure 14:
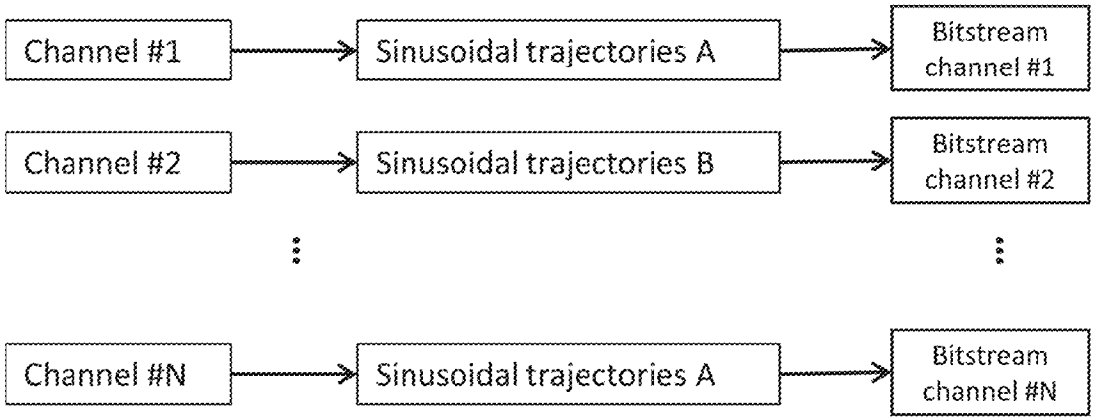

FIG. 14*a* shows an embodiment of the invention for multichannel coding.

Figure 14B:
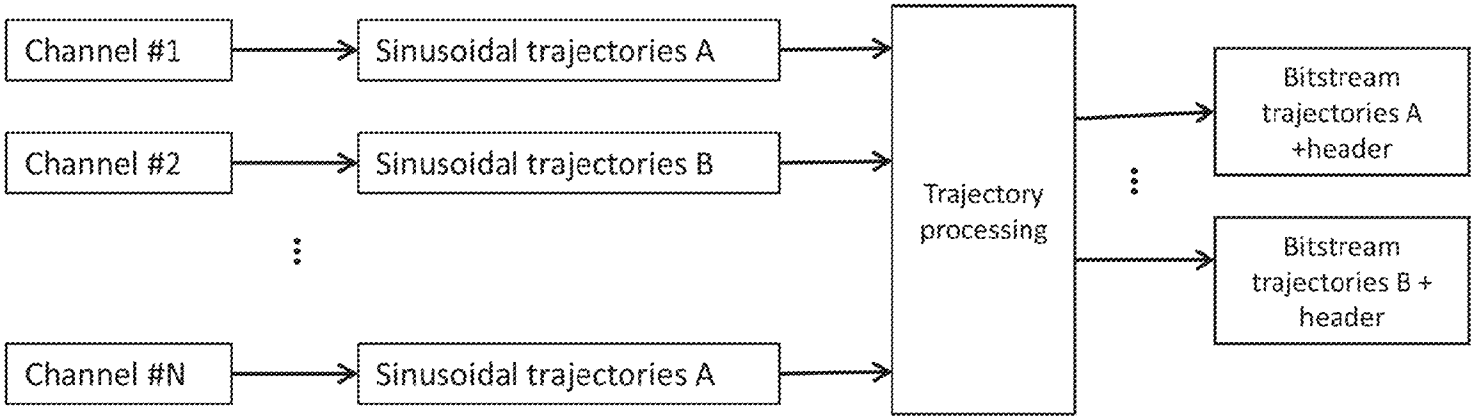

FIG. 14*b* shows an alternative embodiment of the invention for multichannel coding.

FIG. 15 includes the terms and definitions content for a 5.5.X high frequency Sinusoidal Coding Tool.

Identical reference signs refer to identical or at least functionally equivalent features.

DETAILED DESCRIPTION

In the following certain embodiments are described in relation to an MPEG-H 3D Audio Phase 2 Core Experiment Proposal on tonal component coding.

1. Executive Summary

This document provides a full technical description of the High Frequency Sinusoidal Coding (HFSC) for MPEG-H 3D Audio Core Coder. The HFSC tool was already presented in 111th MPEG meeting in Geneva [1] and in 112th meeting in Warsaw [2]. This document supplements the previous descriptions and clarifies all the issues concerning the target bit rate range of the tool, decoding process, sinusoidal synthesis, bit stream syntax and computational complexity and memory requirements of the decoder.

Figure 1:
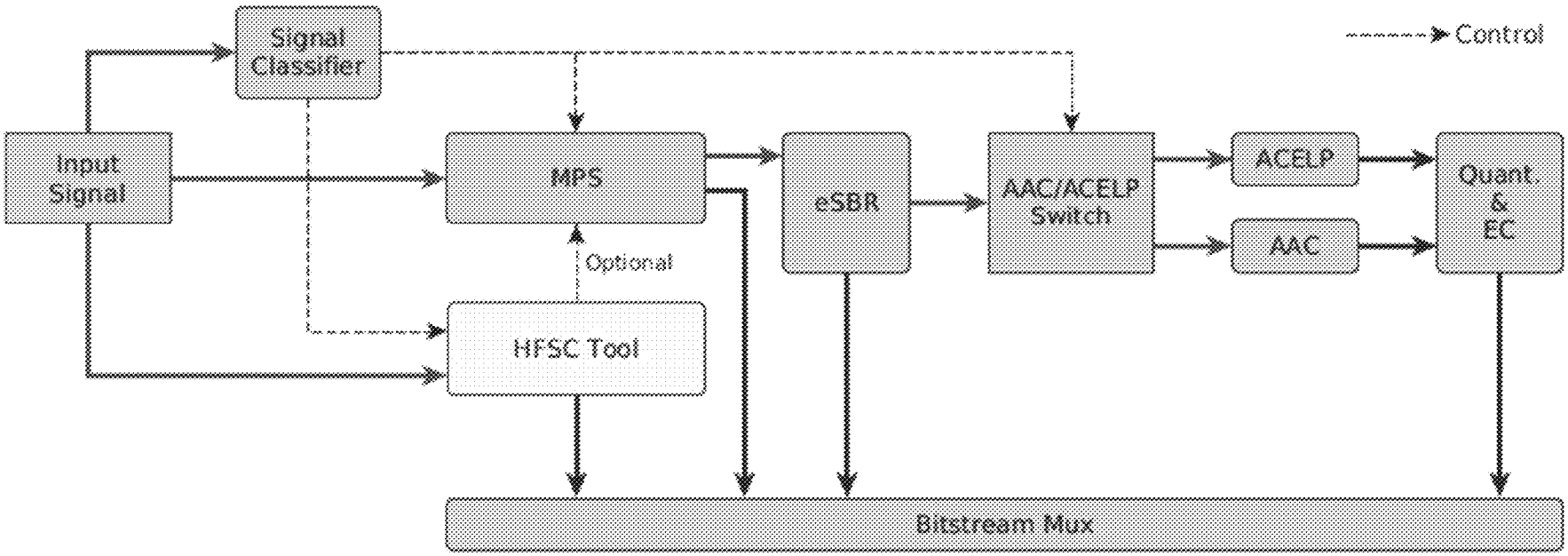
FIG. 1 shows an embodiment of the invention, in particular the general location of the proposed tool within the MPEG-H 3D Audio Core Encoder.

The proposed scheme consists of parametric coding of selected high frequency tonal components using an approach based on sinusoidal modeling. The HFSC tool acts as a pre-processor to MPS in Core Encoder (FIG. 1). It generates an additional bit stream in the range of 0 kbps to 1 kbps only in cases of signals exhibiting a strong tonal character in the high frequency range. The HFSC technique was tested as an extension to USAC Reference Quality Encoder. Verification tests were conducted to assess the subjective quality of proposed extension [3].

2. Technical Description of Proposed Tool 2.1. Functions

The purpose of the HFSC tool is to improve the representation of prominent tonal components in the operating range of the eSBR tool. In general, eSBR reconstructs high frequency components by employing the patching algorithm. Thus, its efficiency strongly depends on the availability of corresponding tonal components in the lower part of the spectrum. In certain situations, described below, the patching algorithm will not be able to reconstruct some important tonal components.

If the signal has a prominent components with fundamental frequency near or above the f_SBR_start frequency. This includes highly pitched sounds, like orchestral bells, and other percussive instruments. In this case, no shifting or scaling is able to re-create such components in the SBR range. The eSBR tool may use an additional technique called "sinusoidal coding" to inject a fixed sinusoidal component into a certain subband of the QMF filterbank. This component has a low frequency resolution and causes a significant discrepancy of timbre due to added in harmonicity.

If the signal has a significantly varying frequency (e.g. vibrato modulation), its energy in the lower band is spread over a range of transform coefficients which are subsequently distorted by quantization. For very low bit rates the local SNR becomes very low, and a partial that was originally purely tonal may not be considered as tonal any more. In such case, different patching variants lead to different additional artifacts:

With harmonic patching mode based on phase vocoder, the quantization noise is further spread in frequency, and affects also the cross-terms With non-harmonic mode (spectral shifting), the frequency modulations are not properly scaled (modulation depth does not increase with partial order).

In our proposal, the HFSC tool is used occasionally, when sounds reach with prominent high frequency tonal partials are encountered. In such situations, prominent tonal components in the range from 3360 Hz to 24000 Hz are detected, their potential distortion by the eSBR tool is analyzed, and the sinusoidal representation of selected components is encoded by the HFSC tool. The additional HFSC data represents a sum of sinusoidal partials with continuously varying frequencies and amplitudes. These partials are encoded in the form of sinusoidal trajectories, i.e. data vectors representing varying amplitude and frequency [4].

HFSC tool is active only when the strong tonal components are detected by dedicated classification tools. It additionally uses Signal Classifier embedded in Core Coder. There might be also an optional pre-processing done at the input of the MPS (MPEG Surround) block in core encoder, in order to minimize the further processing of selected components by the eSBR tool (FIG. 1).

FIG. 1 shows the general location of the proposed tool within the MPEG-H 3D Audio Core Encoder.

2.2. HFSC Decoding Process 2.2.1. Segmentation of Sinusoidal Trajectories

Each individually encoded sinusoidal component is uniquely represented by its parameters: frequency and amplitude, one pair of values per component per each output data frame containing H=256 samples. The parameters describing one tonal component are linked into so called sinusoidal trajectories. The original sinusoidal trajectories build in the encoder may have an arbitrary length. For the purpose of coding, these trajectories are partitioned into segments. Finally, segments of different trajectories starting within particular time are grouped into Groups of Segments (GOS). In our proposal GOS_LENGTH was limited to 8 trajectory data frames, which results in reduced coding delay and higher bit stream granularity.

Data values within each segment are encoded jointly. All segments of a trajectory can have lengths in the range from HFSC_MIN_SEG_LENGTH=GOS_LENGTH to HFSC_MAX_SEG_LENGTH=32 and they are always multiple of 8, so the possible segment length values are: 8, 16, 24, and 32. During encoding process the segments length is adjusted by extrapolation process. Thanks to this the partitioning of trajectory into segments is synchronized with the endpoints of GOS structure, i.e. each segment always starts and ends at the endpoints of GOS structure.

Figure 2:
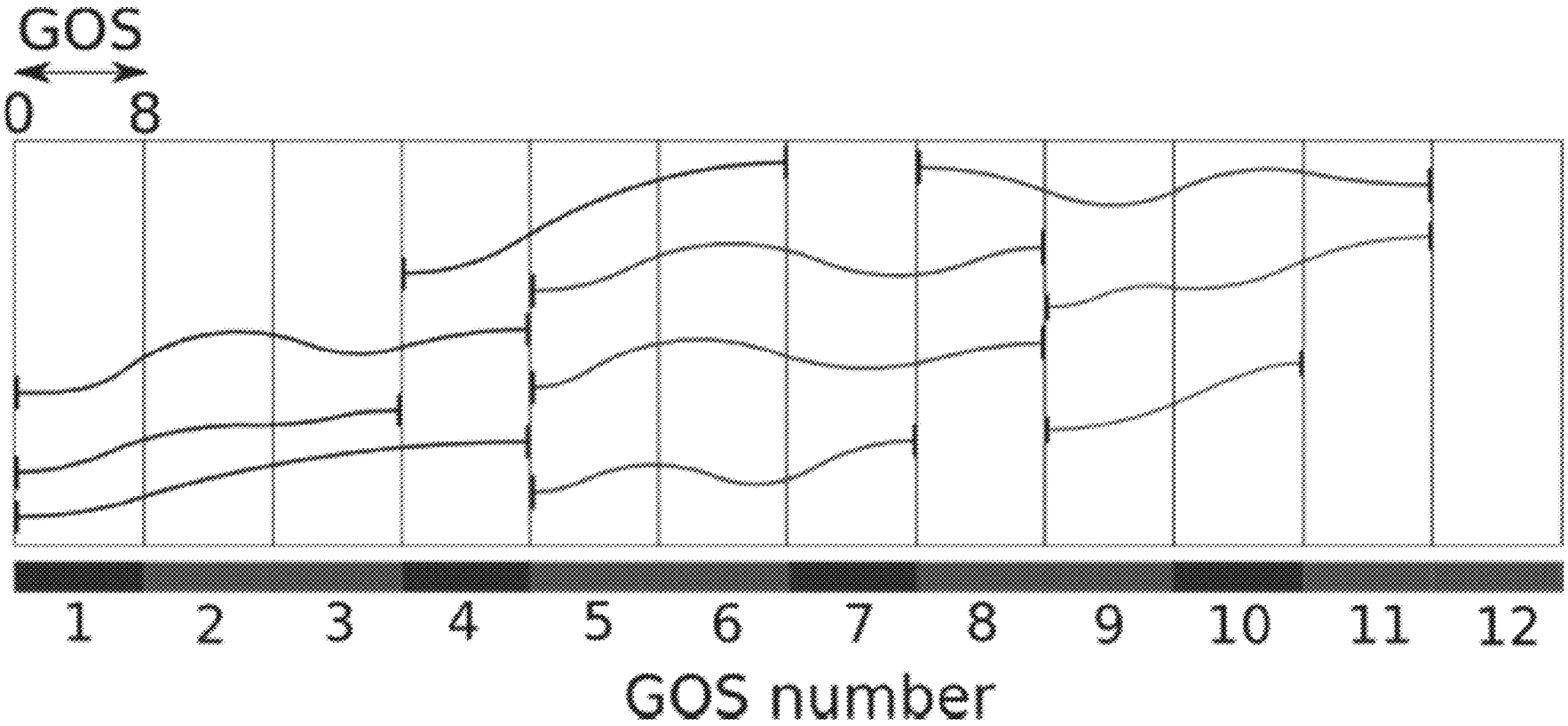
FIG. 2 shows partitioning of sinusoidal trajectories into segments and their relation to GOS according to an embodiment of the invention.

Upon decoding, this segment may continue to the next GOS (or even further), as shown in FIG. 2. After decoding, the segmented trajectories are joined together in the trajectory buffer, as described in section 2.2.2. Decoding process of GOS structure is detailed in Annex A.

FIG. 2 shows partitioning of sinusoidal trajectories into segments and their relation to GOS according to an embodiment of the invention.

Encoding algorithm has also an ability to jointly encode clusters of segments belonging to harmonic structure of the sound source, i.e. clusters represent fundamental frequency of each harmonic structure and its integer multiplications. It can exploit the fact that each segment is characterized with a very similar FM and AM modulations.

2.2.2. Ordering and Linking of Corresponding Trajectory Segments

Each decoded segment contains information about its length and if there will be any further corresponding continuation segment transmitted. The decoder uses this information to determine when (i.e. in which of the following GOS) the continuation segment will be received. Linking of segments relies on the particular order the trajectories are transmitted. The order of decoding and linking segments is presented and explained in FIG. 3.

Figure 3:
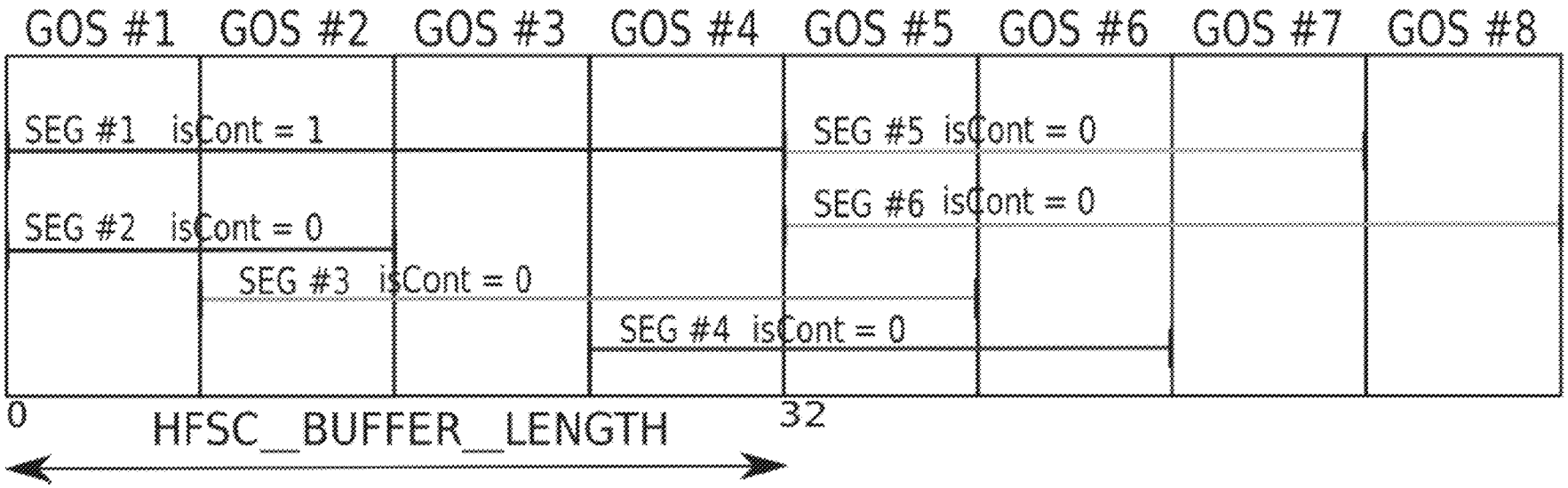
FIG. 3 shows a scheme of linking trajectory segments according to an embodiment of the invention.

FIG. 3 shows a scheme of linking trajectory segments according to an embodiment of the invention. Segments decoded within one GOS are marked with the same color. Each segment is marked with a number (e.g. SEG #5) which determines the order of decoding (i.e. order of receiving the segment data from bitstream). In above example SEG #1 has length of 32 data points and is marked to be continued (isCont=1). Therefore, SEG #1 is going to be continued in GOS #5, where there are two new segments received (SEG #5 and SEG #6). The order of decoding this segments determines that the continuation for SEG #1 is SEG #5.

2.2.3. Sinusoidal Synthesis and Output Signal

The currently decoded trajectories amplitude and frequency data are stored in the trajectory buffers segAmpl and segFreq. The length of each of the buffers is HFSC_BUFF_LENGTH is equal to HFSC_MAX_SEGMENT_LENGTH=32 trajectory data points. In order to keep high audio quality the decoder employs classic oscillator-based additive synthesis performed in sample domain. For this purpose, the trajectory data are to be interpolated on a sample basis, taking into account the synthesis frame length H=256. In order to reduce the memory requirements the output signal is synthesized only from trajectory data points corresponding to currently decoded USAC frame and HFSC_BUFFER_LENGTH is equal to 2048. Once the synthesis is finished the buffer is shifted and appended with new HFSC data. There is no delay added during the synthesis process.

The operation of the HFSC tool is strictly synchronized with the USAC frame structure. The HFSC data frame (GOS) is sent once per 1 USAC frame. It describes up to 8 trajectory data values corresponding to 8 synthesis frames. In other words, there are 8 synthesis frames of sinusoidal trajectory data per each USAC frame and each synthesis frame is 256 samples long at the sampling rate of the USAC codec.

If Core Decoder output is carried in sample domain, the group of 2048 HFSC samples are passed to the output, where the data is mixed with the contents produced by the USAC decoder with appropriate scaling.

If output of the Core Decoder needs to be carried in frequency domain an additional QMF analysis is required. The QMF analysis introduces delay of 384 samples, however it holds within the delay introduced by eSBR decoder. Another option might be direct synthesis of sinusoidal partials to QMF domain.

3. Bitstream Syntax and Specification Text

The necessary changes to the standard text containing bit stream syntax, semantics and a description of the decoding process can be found in Annex A of the document as a diff-text.

4. Coding Delay

The maximum coding delay is related to HFSC_MAX_SEGMENT_LENGTH, GOS_LENGTH, sinusoidal analysis frame length SINAN_LENGTH=2048 and synthesis frame length H=256. Sinusoidal analysis requires zero-padding with 768 samples and overlapping with 1024 samples. The resulting maximum coding delay of HFSC tool is: (HFSC_MAX_SEGMENT LENGTH+GOS_LENGTH−1)*H+SINAN_LENGTH−H=(32+8−1)*256+2048−256=11776 samples. The delay is not added at the front of other Core Coder tools.

5. Stereo and Multichannel Signals Coding

For stereo and multichannel signals each channel is encoded independently. The HFSC tool is optional and may be active only for part of audio channels. The HFSC payload is transmitted in USAC Extension Element. It is recommended to possible to send additional information related to trajectory panning as illustrated in the FIG. 4*b* below to further save some bits. However, due to low bitrate overhead introduced by HFSC each channel can also be encoded independently as illustrated in FIG. 4*a*.

FIG. 4*a* shows an illustration of independent encoding for each channel according to an embodiment of the invention.

FIG. 4*b* shows an illustration of sending additional information related to trajectory panning according to an embodiment of the invention.

6. Complexity and Memory Requirements 6.1. Computational Complexity

The computational complexity of the proposed tool depends on the number of currently transmitted trajectories which in every HFSC frame is limited to HFSC_MAX_TRJ=8. The dominant component of the computational complexity is related to the sinusoidal synthesis.

Time domain synthesis assumptions are as follows:

Taylor series expansions employed for calculating of cos( ) and exp( ) functions 16-bit output resolution The computational complexity of DCT based segment decoding is negligibly small when compared to the synthesis. The HFSC tool generates in average is 0.6 sinusoidal trajectory, thus the total number of operations per sample is 18*0.6=10.8. Assuming the output sampling frequency is 44100 Hz, the total number of MOPS per one channel active is 0.48. When 8 audio channels would be enhanced by HFSC tool, the total number of MOPS is 3.84.

Comparison to the total computational complexity of Core decoder with 22 channels (11 CPE's used): Reference Model Core coder: 118 MOPS

HFSC: 8*0.48=3.48

RM+HFSC=121.48

(RM+HFSC/RM)=1.02

2% increase of computational complexity, when no additional QMF analysis is needed.

6.2. Memory Requirements

For online operation, the trajectory decoding algorithm requires a number of matrices of size:

32×8=256 elements for amplCoeff

32×8=256 elements for freqCoeff

33×8=256 elements for segAmpl

33×8=256 elements for segFreq 32 elements for DCT decoding

The synthesis requires vectors of size:

256*8=2048 elements for amplitude output buffer

256*8=2048 elements for frequency and phase output buffer

Since these elements are used to store a 4-byte floating point values, the estimated amount of memory required for computations is around 20 kB RAM.

The Huffman tables require approximately 250 B ROM.

7. Evidence of Merit

According to workplan [5], the listening tests were conducted for stereo signals with total bitrate of 20 kbps. The listening test report is presented in [3].

8. Summary and Conclusions

In the current document a complete CE proposal of HFSC tool was presented which improves high frequency tonal component coding in MPEG-H Core Coder. Embodiments of the presented CE technology may be integrated into the MPEG-H audio standard as part of Phase 2.

Annex A: Proposed Changes to the Specification Text

The following bit stream syntax is based on ISO/IEC 23008-3:2015 where we propose the following modifications.

Add table entry ID_EXT_ELE_HFSC to Table 50:

TABLE 50

| Value of usacExtElementType | |
|---|---|
| usacExtElementType Value | usacExtElementType Value |
| . . . | . . . |
| ID_EXT_ELE_HFSC 10 | 10 |
| . . . | . . . |

Add table entry ID_EXT_ELE_HFSC to Table 51:

TABLE 51

| Interpretation of data blocks for extension payload decoding | |
|---|---|
| usacExtElementType | The concatenated usacExtElementSegmentData represents: |
| . . . | . . . |
| ID_EXT_ELE_HFSC | HfscGroupOfSegments( ) |
| . . . | . . . |

Add case ID_EXT_ELE_HFSC to syntax of mpegh3daExtElementConfig( ):

TABLE XX

Syntax of mpegh3daExtElementConfig( )

| Syntax | No. of bits | Mnemonic |
|---|---|---|
| mpegh3daExtElementConfig( ) | | |
| { | | |
| ... | | |
| case ID_EXT_ELE_HFSC: /* high freq. sin. coding*/ | | |
| HFSCConfig( ); | | |
| break; | | |
| ... | | |
| } | | |

Add Table XX—Syntax of HFSCConfig( ):

TABLE XX

Syntax of HFSCConfig( )

| Syntax | No. of bits | Mnemonic |
|---|---|---|
| HFSCConfig( ) | | |
| { | | |
| for(elm=0;elm < numElements; elm++) { | | |
| hfscFlag[elm]; | 1 | uimsbf |
| } | | |
| } | | |

NOTE:
numElements corresponds only to SCE, CPE and QCE channel elements.

Add Table XX—Syntax of HfscGroupofSegments( )

TABLE XX

Syntax of HfscGroupOfSegments( )

| Syntax | No. of bits | Mnemonic |
|---|---|---|
| HfscGroupOfSegments( ) | | |
| { | | |
| if(hfscDataPresent){ | 1 | uimsbf |
| numTrajectories; | 3 | uimsbf |
| for(k=0;k<numTrajectories;k++){ | | |
| isContinued[k]; | 1 | uimsbf |
| segLength[k]; | 2 | uimsbf |
| amplQuant[k]; | 1 | uimsbf |
| amplTransformCoeffDC[k]; | 8 | uimsbf |
| j = 0; | NOTE 1) | |
| while(amplTransformIndex[k][j] = huff_dec(huffWord)){ | 1 . . . 12 | |
| if(amplTransformIndex[k][j] == 0) { | | |
| numAmplCoeffs = j; | | |
| break; | | |
| } | | |
| j++; | | |
| } | | |
| for(j=0; j < numAmplCoeffs; j++) | NOTE 2) | |
| amplTransformCoeffAC[k][j]= huff_dec(huffWord); | 1 . . . 15 | |
| freqQuant[k]; | 1 | uimsbf |
| freqTransformCoeffDC[k]; | 11 | uimsbf |
| j = 0; | NOTE 1) | |
| while(freqTransformIndex[k][j] = huff_dec(huffWord)){ | 1 . . . 12 | |
| if(freqTransformIndex[k][j] = =0) { | | |
| numFreqCoeffs = j; | | |
| break; | | |
| } | | |
| j++; | | |
| } | | |
| for(j=0; j < numFreqCoeffs; j++) | NOTE 2) | |
| freqTransformCoeffAC[k][j]= huff_dec(huffWord); | 1 . . . 15 | |
| } | | |
| } | | |
| } | | |

NOTE 1):
Huffman codes table: Table XX
NOTE 2):
Huffman codes table: Table XX

It is proposed to append the following descriptive text to a new section "5.5.X High Frequency Sinusoidal Coding Tool" with the following content:

5.5.X High Frequency Sinusoidal Coding Tool 5.5.X.1 Tool Description

The High Frequency Sinusoidal Coding Tool (HFSC) is a method for coding of selected high frequency tonal components using an approach based on sinusoidal modeling. Tonal components are represented as sinusoidal trajectories—data vectors with varying amplitude and frequency values. The trajectories are divided into segments and encoded with technique based on Discreet Cosine Transform.

5.5.X.2 Terms and Definitions (See FIG. 15.)

5.5.X.3 Decoding Process 5.5.X.3.1 General

Element usacExtElementType ID_EXT_ELE_HFSC according to hfscFlag[ ] contains HFSC data (HFSC Groups of Segments—GOS) corresponding to the currently processed channel elements i.e. SCE (Single Channel Element), CPE (Channel Pair Element), QCE (Quad Channel Element). The number of transmitted GOS structures for particular type of channel element is defined as follows:

TABLE XX

Number of transmitted GOS structures

| USAC element type | Number of GOS structures |
|---|---|
| SCE | 1 |
| CPE | 2 |
| QCE | 4 |

The decoding of each GOS starts with decoding the number of transmitted segments by reading the field numSegments and increasing it by 1. Then decoding of particular k-th segment starts from decoding its length segLength[k] and is Continued[k] flag. The decoding of other segment data is performed in multiple steps as follows: 5.5.X.3.2 Decoding of Segment Amplitude Data The following procedures are performed for k-th segment amplitude data decoding:

1. The amplitude quantization step A step is calculated according to formula:

$$stepA[k] = \log\left(10^{\frac{amplQuant[k]}{20}}\right),$$

where amplQuant[k] is expressed in dB.

2. The amplTransformCoeffDC[k] is decoded according to formula:

$$amplDC[k]=-amplTransformCoeffDC[k]\times stepA[k]+amplOffsetDC$$

3. The amplitude AC indices amplIndex[k][j] are decoded by starting with j=0 and decoding consecutive amplTransformIndex[k][j] Huffman code words and incrementing j, until a codeword representing 0 is encountered. The Huffman code words are listed in huff_idxTab[ ] table. Number of decoded indices indicates number of further transmitted coefficients—numCoeff[k]. After decoding, each index should be incremented by offsetAC.

4. The amplitude AC coefficients are also decoded by means of Huffman code words specified in huff_acTab[ ] table. The AC coefficients are signed values, so additional 1 sign bit sgnAC[k][j] after each Huffman code word is transmitted, where 1 indicates negative value. Finally, the value of AC coefficient is decoded according to formula:

$$amplAC[k][j]=sgnAC[k][j](amplTransformCoeffAC[k][j]-0.25)\times stepA[k]$$

5. Decoded amplitude transform DC and AC coefficients are placed into vector amplCoeff of length equal to segLength[k]. The amplDC[k] coefficient is placed at index 0 and amplAC[k][j] coefficients are placed according to decoded amplIndex[k][j] indices.

6. The sequence of trajectory amplitude data in logarithmic scale is reconstructed from the inverse discrete cosine transform and moved into segAmpl[k][i] buffer according to:

$$segAmpl_{log}[k][i] = \sum_{r=0}^{segLength[k]} amplCoeff[k][r]w[r]\cos\left(\frac{\pi}{2segLength[k]}(h+1)r\right),$$

where:

$$w[r] = \begin{cases} (segLength[k])^{-0.5} & \text{for } r = 0 \\ \sqrt{2}\,(segLength[k])^{-0.5} & \text{for } r > 0 \end{cases}$$

The amplitude data are placed in segAmpl buffer of length equal to HFSC_BUFFER_LENGTH, beginning with the index i=1. The value under index i=0 is set to 0.

7. The linear values of amplitudes in segAmpl[k][i] are calculated by:

$$segAmpl[k][i]\exp(segAmpllog[k][i])$$

5.5.X.3.3 Decoding of Segment Frequency Data

The following procedures are performed for k-th segment frequency data decoding:

1. The frequency quantization stepF[k] is calculated according to formula:

$$stepF[k] = freqQuant[k]\times\log\left(2^{\frac{1}{1200}}\right),$$

where freqQuant[k] is expressed in cents.

2. The freqTransformCoeffDC[k] is decoded according to formula:

$$freqDC[k]=-freqTransformCoeffDC[k]\times stepF[k]+freqOffsetDC$$

3. Decoding process of frequency AC indices is the same as for amplitude AC indices. The resulting data vector is freqIndex[k][j].

4. Decoding process of frequency AC coefficients is the same as for amplitude AC coefficients. The resulting data vector isfreqAC[k] J.

5. Decoded frequency transform DC and AC coefficients are placed into vector freqCoeffof length equal to segLength[k]. The freqDC[k] coefficient is placed in position j=0 and freqAC[k][j] coefficients are placed according to decoded freqIndex[k][j] indices.

6. The reconstruction of sequence of trajectory frequency data in logarithmic scale and further transformation to linear scale is performed in the same manner as for amplitude data. The resulting vector is segFreq[k][i]. The linear values of frequency data are stored in the range from 0.07-0.5. In order to obtain frequency in Hz, decoded frequency values should be multiplied by HFSC_FS.

5.5.X.3.4 Ordering and Linking of Trajectory Segments.

The original sinusoidal trajectories build in the encoder are partitioned into an arbitrary number of segments. The length of currently processed segment segLength[k] and continuation flag is Continued[k] is used to determine when (i.e. in which of the following GOS) the continuation segment will be received. Linking of segments relies on the particular order the trajectories are transmitted. The order of decoding and linking segments is presented and explained in FIG. 3.

5.5.X.3.5 Synthesis of Decoded Trajectories

The received representation of trajectory segments is temporarily stored in data buffers segAmpl[k][i] and segFreq[k][i], where k represents the index of segment not greater than MAX_NUM_TRJ=8, and i represents the trajectory data index within a segment, 0<=i<HFSC_BUFFER_LENGTH. The index i=0 of buffers segAmpl and segFreq is filled with data depending on the one of two possible scenarios for further processing of particular segments:

1. The received segment is starting a new trajectory, then the i=0 index amplitude and frequency data are provided by simple extrapolation process:

$$segFreq[k][0]=segFreq[k][l],$$

$$segAmpl[k][0]=0.$$

2. The received segment is recognized as a continuation for the segment processed in the previously received GOS structure, then the i=0 index amplitude and frequency data are copy of the last data points from the segment being continued.

The output signal is synthesized from sinusoidal trajectory data stored in the synthesis region of segAmpl[k][l] and segFreq[k][l], where each column corresponds to one synthesis frame and l=0, 1, . . . , 8. For the purpose of synthesis, these data are to be interpolated on a sample basis, taking into account the synthesis frame length H=256. The samples of the output signal are calculated according to $$y_{HFSC}[n] = \sum_{k=1}^{K[n]} A_k[n]\cos(\varphi_k[n])$$

where:

n=0 . . . HFSC_SYNTH_LENGTH−1,

K[n] denotes the number of currently active trajectories, i.e. the number of rows synthesis region of segAmpl[k][l] and segFreq[k][l] which have valid data in the frame l=floor(n/H) and l=floor(n/H)+1.

Ak[n] denotes the interpolated instantaneous amplitude of k-th partial,

φk[n] denotes the interpolated instantaneous phase of k-th partial.

The instantaneous phase φk[n] is calculated from the instantaneous frequency Fk[n] according to:

$$\varphi_k[n] = \varphi_k[n_{start}[k]] + 2\pi \sum_{m=n_{start}[k]+1}^{n} F_k[n],$$

where nstart[k] denotes the initial sample, at which the current segment is started. This initial value of phase is not transmitted and should be stored between consecutive buffers, so that the evolution of phase is continuous. For this purpose the final value of $\varphi_{k[HFSC_SYNTH_LENGTH-1]}$ is written to a vector segPhase[k]. This value is used as $\varphi_{k[nstart[k]]}$ during the synthesis in the next buffer. At the beginning of each trajectory, $\varphi_{k[nstart[k]]}=0$ is set.

The instantaneous parameters Ak[n] and Fk[n] are interpolated on a sample basis from trajectory data stored in trajectory buffer. These parameters are calculated by linear interpolation:

$$A_k[n'] = segAmpl[k][h-1] + (segAmpl[k][h] - segAmpl[k][h-1]) * \frac{n' - Hh}{H},$$

$$F_k[n'] = segFreq[k][h-1] + (segFreq[k][h] - segFreq[k][h-1]) * \frac{n' - Hh}{H}$$

where:

$$n' = n - n_{start}$$

$$h = n' \bmod H$$

Once the group of HFSC_SYNTH_LENGTH samples is synthesized, it is passed to the output, where the data is mixed with the contents produced by the Core Decoder with appropriate scaling to the output data range through multiplication by 215. After the synthesis, the content of segAmpl[k][l] and segFreq[k][l] is shifted by 8 trajectory data points and updated with new data from incoming GOS.

5.5.X.3.6 Additional Transform of Output Signal to QMF Domain

Depending on the Core Decoder output signal domain, an additional QMF analysis of the HFSC output signal should be performed according to ISO/IEC 14496-3:2009, subclause 4.6.18.4.

5.5.X.3.7 Huffman Tables for AC Indices

The following Huffman table huff_idxTab [ ] shall be used for decoding the DCT AC indices:

```
huff_idxTab[ ] =
{
  /* index,    length/bits,    deccode,    bincode          */
    {     0,    1,      0},    //                   0
    {     1,    3,      6},    //                 110
    {     2,    3,      7},    //                 111
    {     3,    4,      9},    //                1001
    {     4,    4,     11},    //                1011
    {     5,    5,     17},    //               10001
    {     6,    6,     32},    //              100000
    {     7,    6,     40},    //              101000
    {     8,    6,     42},    //              101010
    {     9,    7,     67},    //             1000011
    {    10,    7,     83},    //             1010011
    {    11,    8,    133},    //            10000101
    {    12,    8,    132},    //            10000100
    {    13,    8,    165},    //            10100101
    {    14,    8,    173},    //            10101101
    {    15,    8,    175},    //            10101111
    {    16,    9,    329},    //           101001001
    {    17,    9,    344},    //           101011000
    {    18,    9,    348},    //           101011100
    {    19,   10,    656},    //          1010010000
    {    20,   10,    698},    //          1010111010
    {    21,   10,    699},    //          1010111011
    {    22,   11,   1380},    //         10101100100
```

-continued

```
    {        23,   11,    1382},    //        10101100110
    {        24,   11,    1383},    //        10101100111
    {        25,   12,    2628},    //       101001000100
    {        26,   12,    2763},    //       101011001011
    {        27,   12,    2629},    //       101001000101
    {        28,   12,    2631},    //       101001000111
    {        29,   13,    5525},    //      1010110010101
    {        30,   12,    2630},    //       101001000110
    {        31,   13,    5524},    //      1010110010100
};
```

5.5.X.3.8 Huffman Tables for AC Coefficients

The following Huffman table huff_acTab[ ] shall be used for decoding the DCT AC values. Each code word in the bitstream is followed by a 1 bit indicating the sign of decoded AC value.

The decoded AC values need to be increased by adding the offset AC value.

```
huff__acTab[ ] =
{
  /* index,     length/bits,    deccode,    bincode          */
    {          0,    6,          31},    //        011111
    {          1,    3,           5},    //           101
    {          2,    3,           1},    //           001
    {          3,    3,           2},    //           010
    {          4,    3,           4},    //           100
    {          5,    3,           7},    //           111
    {          6,    4,           6},    //          0110
    {          7,    4,          13},    //          1101
    {          8,    5,           2},    //         00010
    {          9,    5,          14},    //         01110
    {         10,    6,           0},    //        000000
    {         11,    6,           2},    //        000010
    {         12,    6,           7},    //        000111
    {         13,    6,          30},    //        011110
    {         14,    6,          50},    //        110010
    {         15,    7,           2},    //       0000010
    {         16,    7,           6},    //       0000110
    {         17,    7,          96},    //       1100000
    {         18,    7,          98},    //       1100010
    {         19,    7,          99},    //       1100011
    {         20,    8,           6},    //      00000110
    {         21,    8,          27},    //      00011011
    {         22,    8,           7},    //      00000111
    {         23,    8,          15},    //      00001111
    {         24,    8,          26},    //      00011010
    {         25,    8,         206},    //      11001110
    {         26,    9,          50},    //     000110010
    {         27,    9,          49},    //     000110001
    {         28,    9,          28},    //     000011100
    {         29,    9,          48},    //     000110000
    {         30,    9,         390},    //     110000110
    {         31,    9,         389},    //     110000101
    {         32,    9,          51},    //     000110011
    {         33,   10,          59},    //    0000111011
    {         34,   10,         783},    //    1100001111
    {         35,    9,         408},    //     110011000
    {         36,   10,         777},    //    1100001001
    {         37,   10,          58},    //    0000111010
    {         38,   10,         782},    //    1100001110
    {         39,    8,         205},    //      11001101
    {         40,    9,         415},    //     110011111
    {         41,   10,         829},    //    1100111101
    {         42,   10,         819},    //    1100110011
    {         43,   10,         828},    //    1100111100
    {         44,   11,        1553},    //   11000010001
    {         45,   11,        1637},    //   11001100101
    {         46,   12,        3105},    //  110000100001
    {         47,   14,       12419},    //11000010000011
    {         48,   11,        1636},    //   11001100100
    {         49,   14,       12418},    //11000010000010
    {         50,   13,        6208},    //  1100001000000
};
```

In the following further information about embodiments of the invention is provided.

Subject of the Application:

High Efficiency Sinusoidal Coding low bitrate coding technique for audio signals

- based on high quality sinusoidal model
- extended with transient and noise coding
- bridge between speech and general audio coding techniques
- deals with high frequency artifacts introduced by Spectral Band Replication MPEG-H 3D Audio and Unified Speech and Audio Coding extension MPEG-H 3D Audio/USAC has known problems with high frequency tonal components FIG. 5 shows the motivation for embodiments of the present invention.

FIG. 6 shows exemplary MPEG-H 3D Audio artifacts above fSBR, and in particular that the SBR tool is not capable of proper reconstruction of high frequency tonal components (over fSBR band)

FIG. 7 shows a comparison for 20 kbps (~2 kbps of HESC), fSBR=4 kHz, between "Original", "MPEG 3DA" and "MPEG 3DA+HESC".

In the following further details of embodiments of the invention are described based on claims and examples of Polish patent application PL410945.

Claim 1 of PL410945 (see also [Zernicki et al., 2015] and prior art in [Zernicki et al., 2011]) relates to an exemplary encoding method and reads as follows:

1. An audio signal encoding method comprising the steps of:

- collecting the audio signal samples (114),
- determining sinusoidal components (312) in subsequent frames,
- estimation of amplitudes (314) and frequencies (313) of the components for each frame,
- merging thus obtained pairs into sinusoidal trajectories,
- splitting particular trajectories into segments,
- transforming (318, 319) particular trajectories to the frequency domain by means of a digital transform performed on segments longer than the frame duration,
- quantization (320, 321) and selection (322, 323) of transform coefficients in the segments,
- entropy encoding (328),
- outputting the quantized coefficients as output data (115),
- characterized in that the length of the segments into which each trajectory is split is individually adjusted in time for each trajectory.

FIG. 8 shows a flow-chart of a corresponding exemplary encoding method, comprising the following steps and/or content:

114: audio signal samples per frame

312: determining sinusoidal components

313: estimation of frequencies of the components for each frame

314: estimation of amplitudes of the components for each frame

315: splitting particular trajectories into segments

- - - : merging thus obtained pairs into sinusoidal trajectories

316 & 317: transform the values into the logarithmic scale

320 & 321: quantization

318 & 319: transforming particular trajectories to the frequency domain by means of a digital transform performed on segments longer than the frame duration

320 & 321: quantization

322 & 323: selection of transform coefficients in the segments
324 & 326: array of indices of selected coefficients
325 & 327: array of values of selected coefficients
328: entropy encoding
115: outputting the quantized coefficients as output data Claim 16 of PL410945 (see also [Zernicki et al., 2015] and prior art in [Zernicki et al., 2011]) relates to an exemplary encoder and reads as follows:

16. An audio signal encoder (110) comprising an analog-to-digital converter (111) and a processing unit (112) provided with:

an audio signal samples collecting unit, a determining unit receiving the audio signal samples from the audio signal samples collecting unit and converting them into sinusoidal components in subsequent frames, an estimation unit receiving the sinusoidal components' samples from the determining unit and returning amplitudes and frequencies of the sinusoidal components in each frame, a synthesis unit, generating sinusoidal trajectories on a basis of values of amplitudes and frequencies, a splitting unit, receiving the trajectories from the synthesis unit and splitting them into segments, a transforming unit, transforming trajectories' segments to the frequency domain by means of a digital transform, a quantization and selection unit, converting selected transform coefficients into values resulting from selected quantization levels and discarding remaining coefficients, an entropy encoding unit, encoding quantized coefficients outputted by the quantization and selection unit, and a data outputting unit, characterized in that the splitting unit is adapted to set the length of the segment individually for each trajectory and to adjust this length over time.

FIG. 9 shows a block-diagram of a corresponding exemplary encoder, comprising the following features:
110: audio signal encoder
111: analog-to-digital converter
112: processing unit
115: compressed data sequence
113: audio signal
114: audio signal samples FIG. 10 shows an example analysis of sinusoidal trajectories showing sparse DCT spectra according to prior art.

Claim 10 of PL410945 (see also [Zernicki et al., 2015]) and prior art in [Zernicki et al., 2011]) relates to an exemplary decoding method and reads as follows:

10. An audio signal decoding method comprising the steps of:

retrieving encoded data, reconstruction (411, 412, 413, 414, 415) from the encoded data digital transform coefficients of trajectories' segments, subjecting the coefficients to an inverse transform (416, 417) and performing reconstruction of the trajectories' segments, generation (420, 421) of sinusoidal components, each having amplitude and frequency corresponding to the particular trajectory, reconstruction of the audio signal by summation of the sinusoidal components, characterized in that missing, not encoded transform coefficients of the sinusoidal components' trajectories are replaced with noise samples generated on a basis of at least one parameter introduced to the encoded data instead of the missing coefficients.

FIG. 11 shows a flow-chart of a corresponding exemplary decoding method, comprising the following steps and/or content:
115: transferred compressed data
411: entropy code decoder
324 & 326: reconstructed array of indices of the quantized transform coeff.
325 & 327: reconstructed array of values of the quantized transform coeff.
412 & 413: reconstruction blocks, vectors' elements of transform coeff are filled with the decoded values corresponding to the decoded indices
414 & 415: dequantization, not-encoded coeff. are reconstructed using "ACEnergy" and/or "ACEnvelope"
416 & 417: inverse transform to obtain the reconstructed logarithmic values of frequency and amplitude
418 & 419: convert to linear scale by means of antilogarithm
420 & 421: merging the reconstructed trajectories' segments with the already decoded segments
422: synthesis based on a sinusoidal representation
214: synthesized signal Claim 18 of PL410945 (see also [Zernicki et al., 2015]) and prior art in [Zernicki et al., 2011]) relates to an exemplary decoder and reads as follows:

18. An audio signal decoder 210, comprising a digital-to-analog converter 212 and a processing unit 211 provided with:

an encoded data retrieving unit, a reconstruction unit, receiving the encoded data and returning digital transform coefficients of trajectories' segments, an inverse transform unit, receiving the transform coefficients and returning reconstructed trajectories' segments, a sinusoidal components generation unit, receiving the reconstructed trajectories' segments and returning sinusoidal components, each having amplitude and frequency corresponding to the particular trajectory, an audio signal reconstruction unit, receiving the sinusoidal components and returning their sum, characterized in that it comprises a unit adapted to randomly generate not encoded coefficients on a basis of at least one parameter, the parameter being retrieved from the input data, and transferring the generated coefficients to the inverse transform unit.

FIG. 12 shows a block diagram of a corresponding exemplary decoder comprising the following features:
210: audio signal decoder
213: compressed data
215: analog signal
212: digital-to-analog converter
211: processing unit
214: synthesized digital samples In the following, specific aspects of embodiments of the inventions are described.

Aspect 1: QMF and/or MDCT synthesis

FIG. 13*a* shows another embodiment of the invention, in particular the general location of the proposed tool within the MPEG-H 3D Audio Core Encoder.

FIG. 13*b* shows a part of FIG. 11. The problem of such implementations: due to complexity issue, the amplitudes and frequencies may not always be synthesized directly into the time domain representation.

FIG. 13*c* shows an embodiment of the present invention, wherein the steps depicted therein replace the respective steps in FIG. 13*b*, i.e. provide a solution: depending on the system configuration, the decoder shall perform the processing accordingly.

Aspect 2: Extension of Trajectory Length

Claim 1 of PL410945 specifies: . . . characterized in that the length of the segments into which each trajectory is split is individually adjusted in time for each trajectory.

Such implementations have the problem that the actual trajectory length is arbitrary at the encoder side. This means that a segment may start and end arbitrarily within the group of segments (GOS) structure. Additional signaling is required.

According to an embodiment of the invention the above characterizing feature of claim 1 of PL410945 is replaced by the following feature: . . . characterized in that the partitioning of trajectory into segments is synchronized with the endpoints of the Group of Segments (GOS) structure.

Thus, there is no need for additional signaling since it will always be guaranteed that the beginning and end of a segment is aligned with the GOS structure.

Aspect 3: Information about trajectory panning

Problem: In the context of multichannel coding, it has been found out that the information regarding sinusoidal trajectories is redundant since it may be shared between several channels.

Solution: Instead of coding these trajectories independently for each channel (as shown in FIG. 14*a*), they can be grouped and only signal their presence with fewer bits (as shown in FIG. 14*b*), e.g. in headers. Therefore, it is recommended to send additional information related to trajectory panning.

Aspect 4: Encoding of trajectory groups

Problem: Some trajectories may have redundancies such as the presence of harmonics.

Solution: The trajectories can be compressed by signaling only the presence of harmonics in the bitstream as described below as an example.

Encoding algorithm has also an ability to jointly encode clusters of segments belonging to harmonic structure of the sound source, i.e. clusters represent fundamental frequency of each harmonic structure and its integer multiplications. It can exploit the fact that each segment is characterized with a very similar FM and AM modulations.

Combination of the Aspects

The aspects mentioned above can be applied independently or combined

The benefit of the combination is mostly cumulative. For example, Aspects 2, 3 and 4 can be combined resulting in a total reduced bitrate.

9. References

[1] ISO/IEC JTC1/SC29/WG11/M35934, "MPEG-H 3D Audio Phase 2 Core Experiment Proposal on tonal component coding," 111th MPEG Meeting, February 2015, Geneva, Switzerland.

[2] ISO/IEC JTC1/SC29/WG11/M36538, "Updated MPEG-H 3D Audio Phase 2 Core Experiment Proposal on tonal component coding," 112th MPEG Meeting, June 2015, Warsaw, Poland.

[3] ISO/IEC JTC1/SC29/WG11/M37215, "Zylia Listening Test Report on High Frequency Tonal Component Coding CE," 113th MPEG Meeting, October 2015, Geneva, Switzerland.

[4] Zernicki T., Bartkowiak M., Januszkiewicz L., Chryszczanowicz M., "Application of sinusoidal coding for enhanced bandwidth extension in MPEG-D USAC," Convention paper presented at the 138th AES Convention, Warsaw.

[5] ISO/IEC JTC1/SC29/WG11/N15582, "Workplan on 3D Audio," 112th MPEG Meeting, June 2015, Warsaw, Poland.

[Zernicki et al., 2011] Tomasz Zernicki, Maciej Bartkowiak, Marek Domanski, "Enhanced coding of high-frequency tonal components in MPEG-D USAC through joint application of eSBR and sinusoidal modeling," in ICASSP 2011, pp. 501-504, 2011.

[Zernicki et al., 2015] Tomasz Zernicki, Maciej Bartkowiak, Lukasz Januszkiewicz, Marcin Chryszczanowicz, "Application of sinusoidal coding for enhanced bandwidth extension in MPEG-D USAC," in Audio Engineering Society 138th Convention, Warsaw, Poland, May 2015.

The disclosure of the above references is incorporated herein by reference.

What is claimed is:

1. An audio signal encoding method for stereo or multichannel encoding performed by an encoder, the method comprising:

collecting audio signal samples;

determining sinusoidal components in multiple frames of the audio signal samples;

estimating amplitudes and frequencies of the sinusoidal components for each of the multiple frames; and merging pairs of amplitudes and frequencies into sinusoidal trajectories of channels, wherein the sinusoidal trajectories of channels are grouped to obtain at least two groups, and wherein the presence of sinusoidal trajectories in channels of each group is signaled in a header of a bitstream.

2. The audio signal encoding method according to claim 1, wherein the method further comprises:

splitting the sinusoidal trajectories into segments;

transforming the sinusoidal trajectories to a frequency domain by a digital transform performed on segments longer than a frame duration;

quantizing and selecting of transform coefficients in the segments; and entropy encoding the quantized coefficients.

3. The audio signal encoding method according to claim 2, wherein segments of different sinusoidal trajectories starting within a particular time are grouped into groups of segments (GOS), and wherein partitioning of sinusoidal trajectories into segments is synchronized with at least one of endpoints of the GOS.

4. The audio signal encoding method according to claim 3, wherein a length of each segment is adjusted to synchronize the partitioning of trajectories with the synchronized endpoints.

5. The audio signal encoding method according to claim 3, wherein a length of a group of segments in the GOS is limited to eight frames.

6. The audio signal encoding method according to claim 1, wherein the header of a bitstream signaling the presence of sinusoidal trajectories in channels of each group comprises additional information related to trajectory panning.

7. An audio signal decoding method performed by a decoder, the method comprising:

retrieving encoded data;

reconstructing digital transform coefficients of trajectory segments from the encoded data;

subjecting the digital transform coefficients to an inverse transform and performing reconstruction of the trajectory segments;

generating sinusoidal components from the trajectory segments, each having an amplitude and a frequency associated with a sinusoidal trajectory in a group; and reconstructing the audio signal from the retrieved encoded data by summation of the sinusoidal components, wherein the presence of the sinusoidal trajectories in channels of each group is decoded from information in a header of a bitstream.

8. The audio signal decoding method according to claim 7, wherein segments of different sinusoidal trajectories starting within a particular time are grouped into groups of segments (GOS), and partitioning of sinusoidal trajectories into segments is synchronized with at least one of endpoints of the GOS.

9. The audio signal decoding method according to claim 8, wherein a length of each segment is adjusted to synchronize the partitioning of the sinusoidal trajectories into segments with the endpoints of the GOS.

10. The audio signal decoding method according to claim 8, wherein a length of a group of segments in the GOS is limited to eight frames.

11. The audio signal decoding method according to claim 7, wherein the audio signal decoding method is used for high frequency sinusoidal coding (HFSC) according to a MPEG-H 3D codec.

12. The audio signal decoding method according to claim 7, wherein the method further comprises:

performing a domain mapping or direct synthesis on the sinusoidal components to obtain a sinusoidal representation in a quadrature mirror filter (QMF) or modified discrete cosine transform (MDCT) domain.

13. The audio signal decoding method according to claim 12, further comprising:

determining whether an output in the QMF or MDCT domain is required in a frequency domain, and performing the domain mapping or direct synthesis on the sinusoidal components to obtain the sinusoidal representation in the QMF or MDCT domain.

14. The audio signal decoding method according to claim 12, further comprising:

determining that an output of the QMF or MDCT in a frequency domain is required, when a core decoder provides an output in the QMF or MDCT domain.

15. An audio signal decoding apparatus comprising:

a processor and a memory coupled to the processor having processor-executable instructions stored thereon, which when executed cause the processor, cause the processor to implement operations including:

retrieving encoded data;

reconstructing digital transform coefficients of trajectory segments from the encoded data;

subjecting the digital transform coefficients to an inverse transform and performing reconstruction of the trajectory segments;

generating sinusoidal components from the trajectory segments, each having an amplitude and a frequency associated with a sinusoidal trajectory in a group; and reconstructing the audio signal from the retrieved encoded data by summation of the sinusoidal components, wherein the presence of the sinusoidal trajectories in channels of each group is decoded from information in a header of a bitstream.

16. The audio signal decoding apparatus according to claim 15, wherein segments of different sinusoidal trajectories starting within a particular time are grouped into groups of segments (GOS), and partitioning of sinusoidal trajectories into segments is synchronized with at least one of endpoints of the GOS.

17. The audio signal decoding apparatus according to claim 16, wherein a length of each segment is adjusted to synchronize the partitioning of trajectories with the synchronized endpoints.

18. The audio signal decoding apparatus according to claim 16, wherein a length of a group of segments is limited to eight frames.

19. The audio signal decoding apparatus according to claim 16, wherein the operations include:

performing a domain mapping or direct synthesis on the sinusoidal components to obtain the sinusoidal representation in a quadrature mirror filter (QMF) or modified discrete cosine transform (MDCT) domain.

20. The audio signal decoding apparatus according to claim 19, wherein the operations include:

determining whether an output in the QMF or MDCT frequency domain is required, and performing the domain mapping or direct synthesis on the sinusoidal components to obtain the sinusoidal representation in the QMF or MDCT domain.

* * * * *